US006274097B1

(12) United States Patent
Sefalidis et al.

(10) Patent No.: US 6,274,097 B1
(45) Date of Patent: Aug. 14, 2001

(54) APPARATUS FOR CLEANING POLLUTANT-LADEN WASTE GAS

(75) Inventors: Vassilios Sefalidis, Allerheiligen; Johannes Schedler; Heimo Thalhammer, both of Graz, all of (AT)

(73) Assignee: Chemisch Thermische Prozesstechnik, Graz (AT)

( * ) Notice: Subject to any disclaimer, the term of this patent is extended or adjusted under 35 U.S.C. 154(b) by 0 days.

(21) Appl. No.: 09/183,544

(22) Filed: Oct. 29, 1998

(30) Foreign Application Priority Data

Oct. 30, 1997 (DE) ..... 197 47 905

(51) Int. Cl.[7] ..... F27G 7/06; F01N 3/10

(52) U.S. Cl. ..... 422/175; 422/173; 422/178; 110/211; 110/212; 431/5

(58) Field of Search ..... 422/171, 173, 422/175, 178; 110/211, 212; 431/5

(56) References Cited

U.S. PATENT DOCUMENTS 5,297,954 * 3/1994 Colagiovanni ..... 422/173

FOREIGN PATENT DOCUMENTS

WO 90/14560 * 11/1990 (WO) .

* cited by examiner

*Primary Examiner*—Hien Tran
(74) *Attorney, Agent, or Firm*—Mueller and Smith, L.P.A.

(57) ABSTRACT

An apparatus for cleaning pollutant-laden waste gas by regenerative thermal afterburning has two towers (1, 2) each divided into three heat-retaining chambers (14 to 16 and 17 to 19) by vertical partitions (10 to 13). Two opposite heat-retaining chambers (14 to 16 and 17 to 19) of the towers (1, 2) are connected by one switching chamber (26, 27, 28) in each case, said chambers being disposed between a loaded gas supply channel (29) and a clean gas removal channel (23). For alternately supplying loaded gas to two opposite heat-retaining chambers of the towers and removing clean gas from two other opposite heat-retaining chambers of the towers, each switching chamber (26, 27, 28) is adapted to be connected alternatively with the loaded gas supply channel (29) and the clean gas removal channel (23) by shut-off devices (50, 52, 53) operated with a control unit.

14 Claims, 5 Drawing Sheets

APPARATUS FOR CLEANING POLLUTANT-LADEN WASTE GAS

This invention relates to an apparatus for cleaning pollutant-laden waste gas by regenerative thermal after burning.

Such plants for cleaning in particular waste air containing organic compounds such as solvents are known (cf. EP 0 472 605 B1). Each tower forms a chamber, the organic compounds in the waste air being burned in the combustion space connecting the upper ends of the two chambers. When waste air is supplied to the chamber in the first tower, it is preheated by the heated heat-retaining packing thereof, the organic compounds in the preheated waste air are burned in the combustion space, and the heat-retaining packing in the chamber in the second tower is heated by hot cleaned waste air. Then the supply of waste air is switched to the chamber in the second tower, while cleaned waste air is drawn off from the chamber of the first tower.

In the known apparatus, two pipes with a large diameter corresponding to the high throughput of such a cleaning apparatus and connected via connection pieces to a prechamber below each tower extend in practice in the longitudinal direction under the side-by-side towers for supplying waste air to be cleaned or loaded gas and for removing cleaned waste air or clean gas. The openings of the two connection pieces into the prechamber are provided with shut-off devices each operated by a control unit formed by a piston/cylinder unit disposed below the large pipe Due to the prechamber disposed under each tower and necessarily having a suitable height for ensuring the function of the shut-off devices, and due to the control units disposed under the pipes, the known apparatus has a considerable height and thus corresponding weight. Also, a shaft or the like must be provided under each control unit for removal thereof and the fixed equipment thereof. Further, the prechambers for operating the shut-off devices under the towers form a dead volume which reduces the cleaning effect.

The problem of the invention is therefore to improve the cleaning power of the known regenerative thermal after burning apparatus while reducing dimensions, weight and costs.

Due to the division of the towers into a plurality of heat-retaining chambers and due to the switching chambers connecting two opposite heat-retaining chambers of the two towers in each case, the channels for supplying loaded gas and removing clean gas are combined together with the switching chambers into a compact unit in the inventive apparatus, so that the apparatus has a much smaller overall volume and weight than known waste gas cleaning apparatuses with regenerative thermal after burning.

The overall volume and weight of the inventive apparatus are reduced further if the two channels for supplying loaded gas with the intermediate switching chambers are disposed one above the other.

Furthermore, one achieves a substantial additional reduction of overall volume and weight of the inventive apparatus if the two towers are disposed at a distance apart so as to form a space and at least part of the unit consisting of the two channels with the intermediate switching chambers is disposed in this space. Moreover, the overall volume is considerably reduced if the control units for the shut-off devices are disposed in the space between the two towers.

Compared to a conventional waste gas cleaning apparatus with regenerative thermal afterburning, the weight and height of the apparatus can thus be reduced according to the invention by more than one third, and the ground plan thereof by about one sixth. This accordingly reduces production costs. It also permits the inventive apparatus to be set up e.g. inside buildings or on a roof.

The inventive apparatus can be delivered as one whole operable unit. The assembly of the apparatus including all electric supply and measuring devices and optionally also the flush gas pipework can thus be done exclusively in the factory, where tests and preliminary operation can also be performed. This shortens erection time on the building site by almost two thirds.

The whole plant can at the same time be supported on the frame bearing the two towers. The whole system need merely be placed on four concrete foundations. One can thus dispense with the elaborate steel substructure required by the known apparatus. Due to the low height of the inventive plant, one can also do without an elaborate stage and stair construction providing access to the combustion chamber. A simple ladder suffices.

The control units for operating the shut-off devices connecting the switching chambers alternately with the loaded gas supply channel and clean gas removal channel, and the flush device are tempered by being arranged in the space between the towers, so that they also work reliably at a cold ambient temperature, for example in the winter.

Due to the arrangement of the clean gas supply channel above the switching chambers and the loaded gas channel therebelow, all lifting rods for moving the By closing bodies up and down and their bearings are located in an area which is not reached by loaded gas- This substantially extends the life of the lifting rods and their bearings in particular when corrosive or dust-laden waste gases are to be cleaned. Suspended installation of the relatively heavy closing bodies on the lifting rods furthermore eliminates the danger of the lifting rods tilting. Also, the inventive apparatus is extremely easy to maintain. Work on the control units and shut-off devices can be done easily and safely because personnel need not go into the apparatus. The same applies to cleaning the lower area of the heat-retaining packings.

Moreover, only small pressure loss differences occur when the direction of gas flow is changed. Longer gas paths on the average result in the combustion space than hitherto although the volume thereof has remained the same, which has a positive effect on cleaning power. Due to the possibility of mounting the burner in the floor rather than on a side wall of the combustion space, and the resulting flame symmetry, there is no necessity to install costly metallic heat-resistant gas turbulators, in particular when the partitions dividing the heat-retaining chambers extend into the combustion space.

The burner can also be disposed on the ceiling of the combustion space, but it saves more space to position it on the floor thereof. Also, a plurality of burners can be provided. The burner or burners can likewise be replaced by other burning devices, for example electric heating elements.

While the lower area of the reactor must generally be insulated from the outside in known waste gas cleaning apparatuses with regenerative thermal afterburning, the surface to be insulated can be reduced by more than two thirds in the inventive apparatus.

The two towers are preferably divided in the inventive apparatus into three heat-retaining chambers by the partitions extending from the bottom to the top, two opposite heat-retaining chambers of the two towers being connected with one joint switching chamber and each of the three switching chambers being adapted to be connected with a flush gas pipe. This embodiment of the inventive apparatus with altogether six heat-retaining chambers achieves a cleaning power of 99.5%. If one control unit or shut-off device fails, the apparatus can be operated as a four-heat-retaining-chamber system instead of a six-heat-retaining-chamber system, still having a cleaning power of 98%. The necessary maintenance work on the failed control unit or shut-off device can be done during four-heat-retaining-chamber operation.

The switching chambers are preferably separated from the loaded gas supply channel and clean gas removal channel by lower and upper partitions, the two partitions of each switching chamber being provided with an opening to be closed by the closing body of the shut-off device.

The two openings of each switching chamber are preferably flush with each other, the two closing bodies for the two openings being displaceable between two stops and spring-loaded away from each other jointly on one lifting rod. The two stops are disposed at a distance apart such that both closing bodies on the lifting rod come to lie simultaneously against the inner side of the two openings of the particular switching chamber, on the one hand, while only one closing body lies against one or the other opening in one or the other partition, on the other hand. This embodiment cuts in half the number of control units, the corresponding periphery and the failure probability. The control units are preferably formed by double-acting pneumatic piston/cylinder units.

If a fan is inserted between the waste gas source and the waste gas cleaning plant for conveying loaded gas into the waste gas cleaning plant, a buffer tank is preferably provided as a pressure fluctuation flattener between the fan and the waste gas cleaning plant.

In the inventive apparatus a catalyst can be provided in addition to the heat-retaining packing or instead of the upper layer thereof. Catalytic regenerative thermal afterburning would then be performed.

BRIEF DESCRIPTION OF THE DRAWINGS

An embodiment of the inventive apparatus will be explained in more detail below with reference to the drawing, in which.

Figure 1:
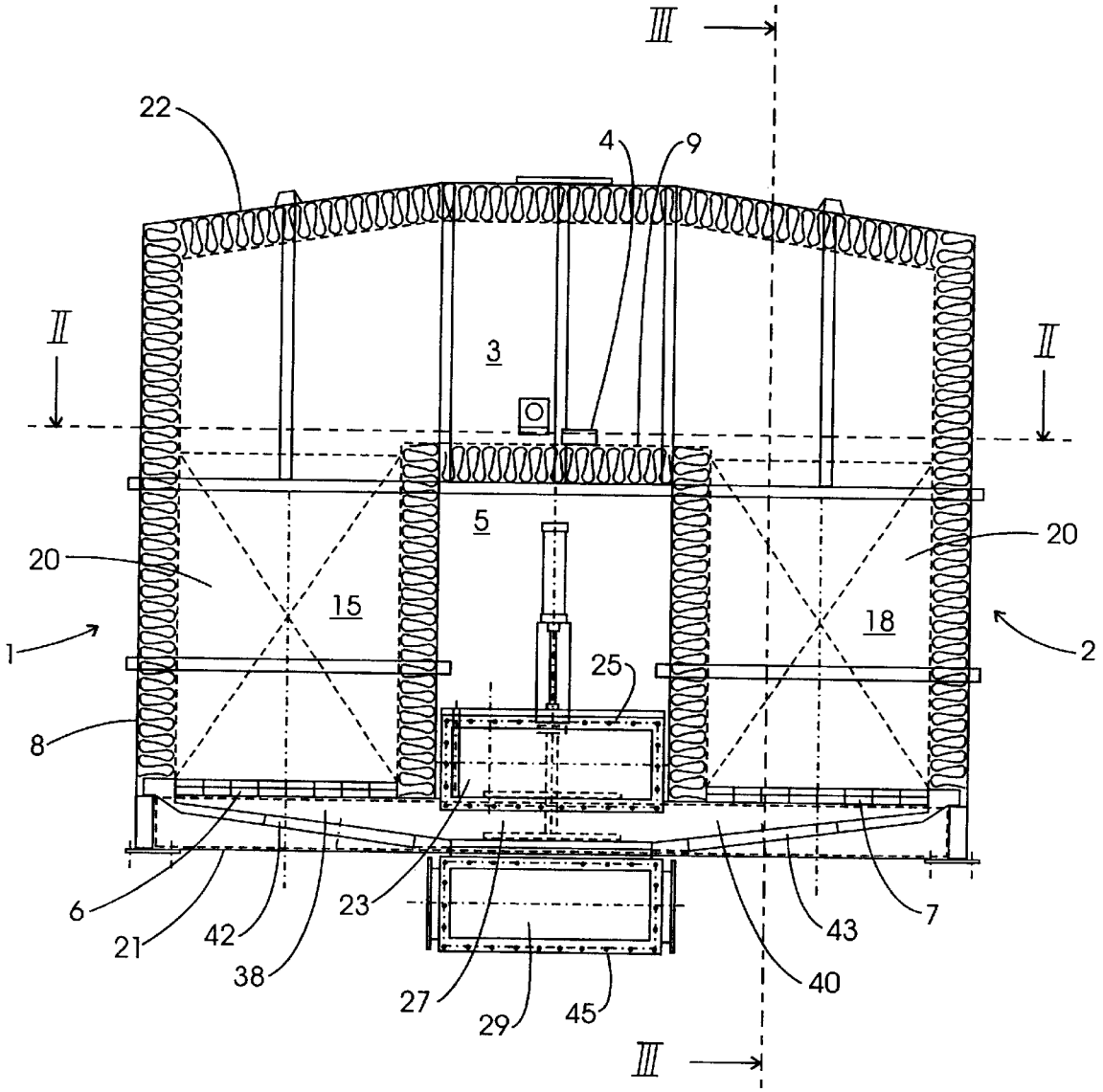
FIG. 1 shows a cross section through the waste gas cleaning apparatus.

According to FIGS. 1 and 2 the regenerative thermal afterburning reactor has two towers 1 and 2 connected via combustion space 3 with burner 4 as a device for burning organic or other combustible pollutants in the loaded gas to be cleaned Below combustion space 3 towers 1, 2 are separated from each other by space 5. Burner 4 is provided on floor 9 in the middle of combustion space 3.

At their lower end towers 1, 2 are provided with grates 6. The total inside wall of the reactor, i.e. of towers 1, 2 including combustion space 3 and the area with space 5, apart from grates 6, 7, is lined with heat insulation 8.

Figure 2:
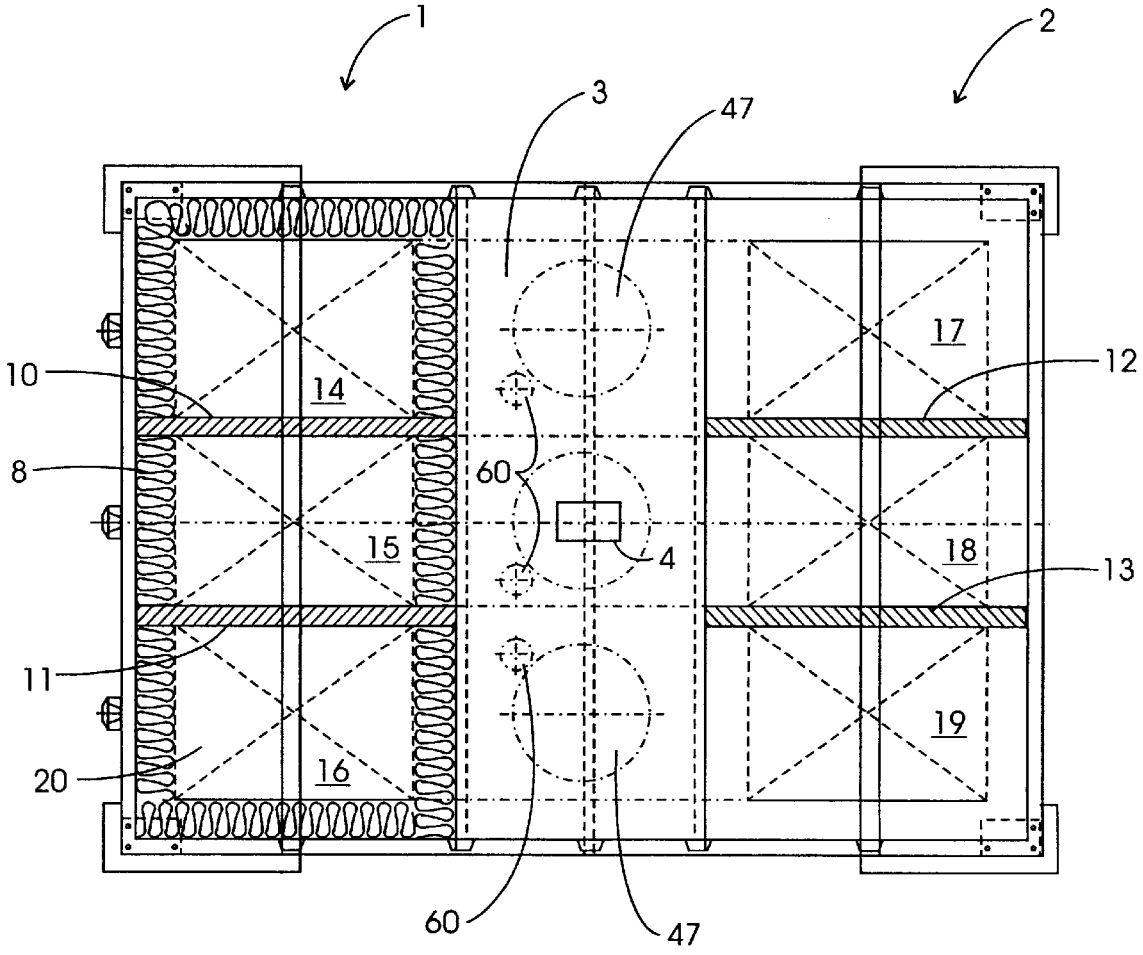
FIG. 2 show a section along line II—II in FIG. 1.
Figure 3:
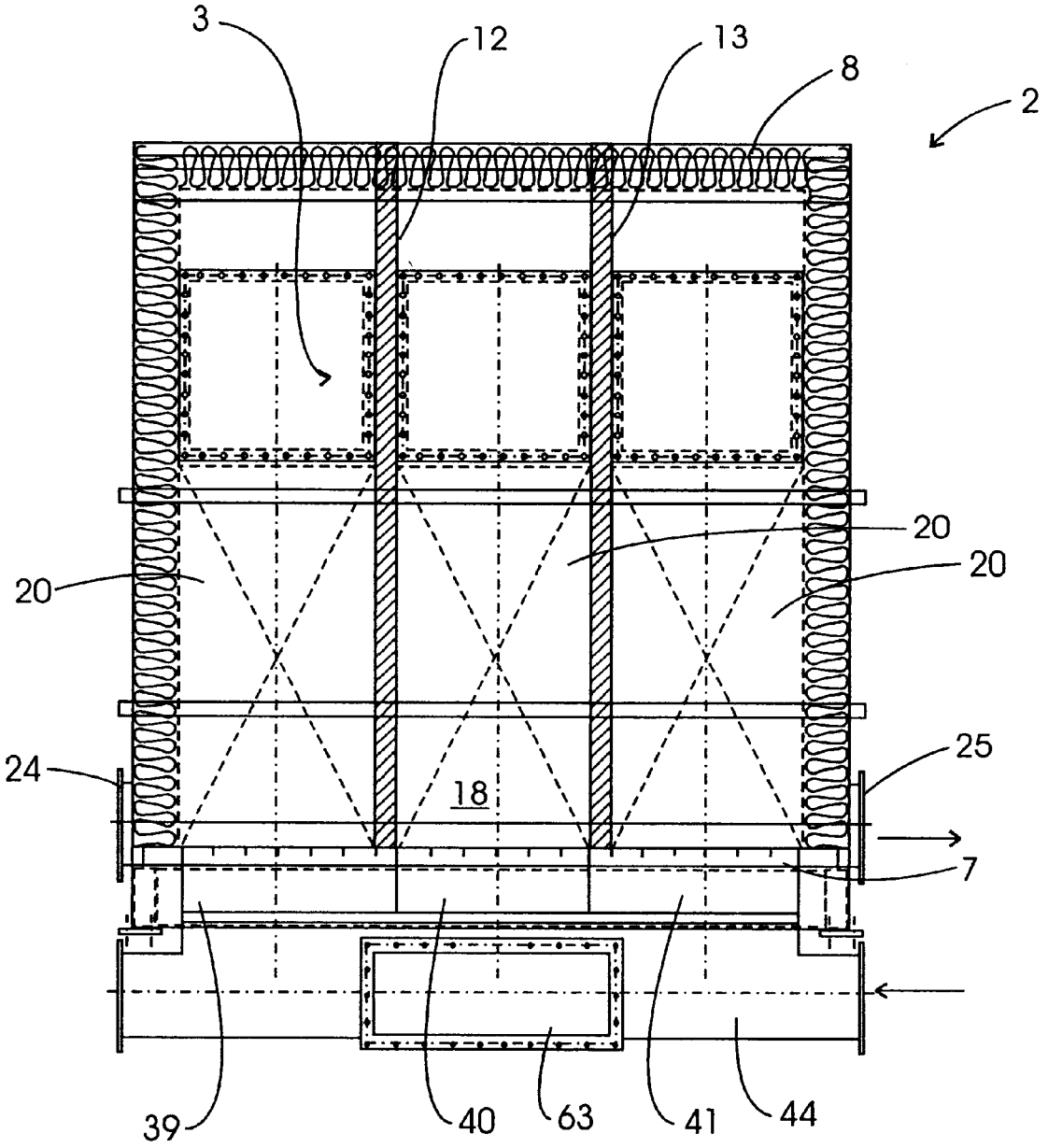
FIG. 3 shows a longitudinal section along line III—III in FIG. 1.

Each tower 1, 2 is divided according to FIGS. 2 and 3 by vertical partitions 10, 11, 12, and 13 into three, substantially equally large heat-retaining chambers 14, 15 and 16 or 17, 18 and 19. Partitions 10 to 13, which are made of a ceramic material, extend up to the ceiling of the reactor and serve at the same time as heat insulation. Heat-retaining chambers 14 to 19 are disposed so that each heat-retaining chamber 14, 15 and 16 of one tower 1 is opposite one heat-retaining chamber 17, 18 and 19 of tower 2 on the other side of space 5.

Heat-retaining chambers 14 to 19 are filled up to the height of combustion space 3 with heat-retaining packing 20 supported on grate 6 or 7. The space above heat-retaining packings 20 is formed by joint combustion space 3.

Heat-retaining packings 20 can be ceramic packing or ceramic honeycomb bodies, for example according to EP 0 472 605 B1. Grates 6, 7 are supported on frame 21 which carries the total reactor.

In the lower area of space 5 clean gas removal channel 23 extends in the longitudinal direction of the reactor, being formed as rectangular pipe 24 and extending from one to the other face of the reactor. At one end of pipe 23 there is flange 25 to which the clean gas removal pipe (not shown) is connected.

Below clean gas removal channel 23 three switching chambers 26, 27 and 28 are disposed in tandem, and below switching chambers 26, 27 and 28 there is loaded gas supply channel 29.

Figure 4:
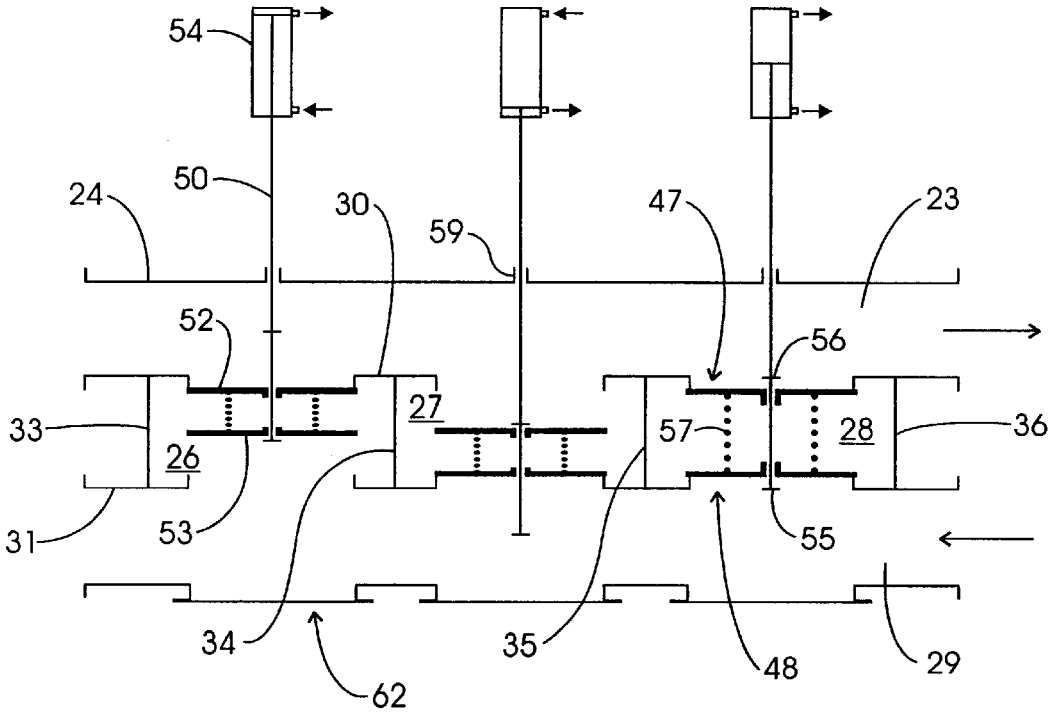
FIG. 4 shows schematically a longitudinal section through the loaded gas supply channel and clean gas removal channel and the intermediate switching chambers with a first variant of the shut-off devices in three different switching positions.

As evident in particular from FIG. 4, switching chambers 26, 27, 28 are separated by upper partition 30 and lower partition 31 from clean gas removal channel 23 and loaded gas supply channel 29. Transverse walls 33, 34, 35, and 36 separate switching chambers 26, 27, 28 from one other and close switching chambers 26 and 28 on the outer faces thereof.

Switching chambers 26, 27, 28 are, as shown by switching chamber 27 in FIG. 1, connected with two opposite heat-retaining chambers 14 and 18 or, as shown in FIG. 1, 15 and 18 as well as 16 and 19 of towers 1, 2 via gas through channels 38, 39, 40,41.

Through channels 39 to 41 are separated from one other by transverse walls 33 to 36 (FIG. 4) and closed thereby on the faces of the reactor. They end under grates 6 and 7 and are closed at the bottom by bottom walls 42 and 43.

Loaded gas supply channel 29 extends, like clean gas removal channel 23, from one to the other face of the reactor, is likewise formed as rectangular pipe 44 and provided at one end with flange 45 to which the loaded gas supply pipe (not shown) is connected.

The two channels 23, 29 for removing clean gas and supplying loaded gas and intermediate switching chambers 26, 27, 28 thus form one unit, optionally together with through channels 38 to 41.

For alternately supplying loaded gas to two opposite heat-retaining chambers 14 and 17, 15 and 18 or 16 and 19 of towers 1 and 2 and for removing clean gas from two other opposite heat-retaining chambers 14 and 17, 15 and 18 or 16 and 19, switching chambers 26, 27, 28 are provided with shut-off devices for closing openings 47, 48 in partitions 30, 31 connecting switching chambers 26, 27, 28 with clean gas removal channel 23 and loaded gas supply channel 29 in each case.

The shut-off devices consist in each case of lifting rod 50 with one (FIGS. 5 to 7) or two (FIG. 4) closing bodies formed as lift valve disks 51 or 52, 53. The shut-off devices are operated by control units preferably formed as pneumatic double-acting piston/cylinder units 54, the piston rod thereof being at the same time flush with lifting rod 50. Piston/cylinder units 54 are disposed in space 5 between towers 1, 2.

In the embodiment of FIG. 4 the two openings 47, 48 are flush with each other on the top and bottom of each switching chamber 26, 27, 28, i.e. they are disposed coaxially with lifting rod 50 for operating the two lift valve disks 52, 53 of particular switching chamber 26, 27, 28 in this embodiment.

The two lift valve disks 52, 53 are displaceable on lifting rod 50 between two stops 55, 56 and loaded against each other by spring 57.

In their closed position lift valve disks 52, 53 lie against the inner side of switching chambers 26, 27, 28, i.e. on the underside of upper partition 30 and on the upper side of lower partition 37. Stops 55, 56 are disposed at a distance apart such that the two lift valve disks 52, 53 can be brought simultaneously in the closed position, as shown for the right-hand shut-off device in FIG. 4. Piston or lifting rods 50 are mounted in each case in bearing 59 above clean gas removal channel 23 through which they extend to switching chambers 26, 27, 28.

Connected to each switching chamber 26, 27, 28 is flush gas pipe 60, as shown schematically in FIG. 2, whereby part of the clean gas can be used as the flush gas.

During operation, pollutant-laden loaded gas flows into loaded gas supply channel 29 at 45. From the loaded gas supply channel it passes at the switching position shown in FIG. 4 into switching chamber 26, from which it flows in two directions, i.e. via through channel 39 and the opposite through channel into heat-retaining chamber 17 of tower 2 and into opposite heat-retaining chamber 14 of tower 1. Loaded gas then flows from the bottom to the top through heat-retaining packing 20 in heat-retaining chambers 14 and 17, which have been heated in the prior cycle, and takes up the heat.

The gas substreams passing out of heat-retaining packings 20 of heat-retaining chambers 14 and 17 unite in combustion space 3, the contained combustible pollutants being burned by the flame of burner 4, whereupon the gas stream divides again to emit its heat to heat-retaining packing 20 in the two adjacent heat-retaining chambers 15 and 18 connected via switching chamber 27 with clean gas removal channel 23. That is, clean gas leaving the flame of burner 4 flows downward through heat-retaining packings 20 in the two heat-retaining chambers 15 and 18 and then via through channels 38 and 40 into switching chamber 27, from where clean gas passes through opening 47 into clean gas removal channel 23.

During this operating state, the third pair of heat-retaining chambers 16 and 19 is flushed with flush gas which is supplied to switching chamber 28 whose upper and lower openings 47, 48 are closed by the two lift valve disks 52, 53. The flush gas thus passes from flush gas pipe 60 via through channel 41 and the opposite through channel to heat-retaining chambers 16 and 19 which were subjected to loaded gas in the previous operating state.

If loaded gas is to flow for example through the two heat-retaining chambers 16 and 19, piston/cylinder unit 54 for switching chamber 28 is subjected to compressed air such that lifting rod 50 travels upward, causing lower stop 55 to draw both lift valve disks 52, 53 including spring 57 upward so far that upper disk 52 closes opening 47 to clean gas removal channel 23. This at the same time draws lower disk 53 upward such that lower opening 48 is opened and loaded gas thus flows from loaded gas supply channel 29 via through channel 41 and the opposite through channel into heat-retaining chambers 16 and 19 of towers 1 and 2. When heat-retaining packings 20 in heat-retaining chambers 16 and 19 have cooled after a certain time, the next operating state is entered, i.e. switching chamber 28 and through channel 41 as well as the opposite through channel, which still contain waste gas, are flushed with flush gas from pipe 60. For this purpose the compressed air in pneumatic piston/cylinder unit 54 is relaxed, so that spring 57 urges the two disks 52, 53 from the inner side of switching chamber 26 against the two openings 47, 48 (flush position), thereby tightly separating the area to be flushed from loaded gas supply channel 29 and clean gas removal channel 23. The flush gas can then be passed from flush gas pipe 60 into switching chamber 28, divides to the left and right into through channel 41 and the opposite through channel and flushes heat-retaining packings 20 in the two heat-retaining chambers 16 and 19 from the bottom to the top. Residual waste gas thus passes into combustion space 3 where it is cleaned by combustion. In the subsequent operating state, heat-retaining chambers 16 and 19 receive clean gas. The shut-off device, i.e. lifting rod 50 with disks 52 and 53, assumes its third position in which piston/cylinder unit 54 is accordingly subjected to compressed air. Lifting rod 50 thus moves downward. With the aid of upper stop 55 the two disks 52, 53 together with spring 57 are moved downward until opening 48 to loaded gas supply channel 29 is closed. Cleaned gas can thus leave heat-retaining chambers 16 and 19 at the bottom and pass into clean gas removal channel 23.

Figure 5:
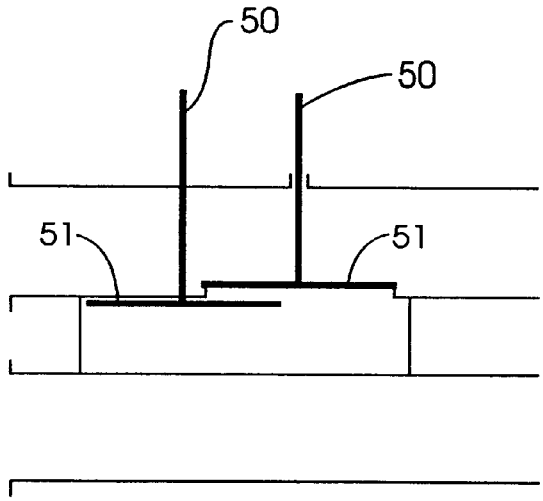
FIGS. 5 and 6 show schematically a longitudinal section through one of the switching chambers with another variant of the shut-off devices in first and second switching positions.
Figure 6:
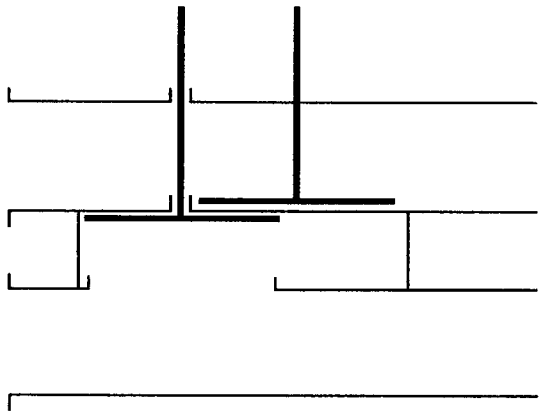
Figure 7:
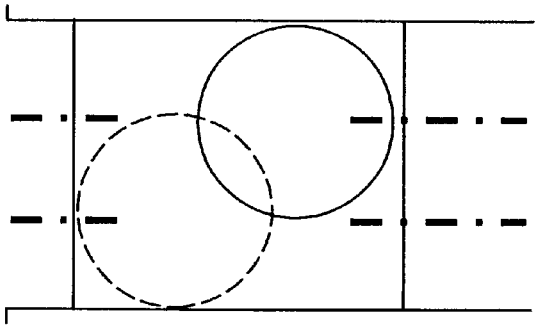
FIG. 7 shows a plan view of the switching chamber of FIGS. 5 and 6.

FIGS. 5 to 7 show another variant of the shut-off devices. That is, in this variant the shut-off devices provided for each of the three switching chambers 26 to 28 are two lifting rods 50 with one lift valve disk 51 fastened thereto in each case. Openings 47, 48 in upper partition 30 and lower partition 31 are obliquely offset from each other, as evident in particular from FIG. 7. Disks 51 fastened rigidly to lifting rods 50 lie against the top of partition 30 or partition 31 in the closed position.

The variant of FIGS. 5 to 7 has six lifting rods and thus six piston/cylinder units as opposed to three lifting rods 50 and three piston/cylinder units 54 in the variant of FIG. 4, but the variant of FIGS. 5 to 7 can prove more robust In any case the variant of FIGS. 5 to 7 also permits a space-saving arrangement due to offset openings 47 and 48.

The structure and function of the reactor correspond to the embodiment of FIGS. 1 to 4.

On the underside of loaded gas channel 29 there are manholes 62 providing access to the particular valve system for maintenance, cleaning or repair work.

Loaded gas channel 29 is suspended below the reactor so that it can be supplied from all directions; one can thus often dispense with an elaborate loaded gas supply pipe guided around corners. FIG. 3 shows lateral opening 63 on loaded gas channel 29 which can be used for systems supplied in the transverse direction of the reactor.

We claim:

1. An apparatus for cleaning pollutant-laden waste gas by regenerative thermal afterburning having two towers containing heat-retaining packing and connected at their upper ends via a combustion space, a channel (29) for supplying loaded gas to be cleaned and a channel (23) for removing clean gas which are adapted to be connected with the two towers by shut-off devices operated by control units for alternately supplying loaded gas and removing clean gas, which comprises:

each tower (1, 2) being divided into at least two heat-retaining chambers (14 to 16, and 17 to 19) by partitions (10 and 11, 12 and 13) extending from the bottom to the top of the tower, the heat-retaining chamber of one tower being connected to the opposite heat-retaining chamber of the other tower by one switching chamber (26, 27, 28) in each case, the switching chambers (26, 27, 28) being disposed between the two channels (29, 23) for supplying loaded gas and removing clean gas, and each switching chamber (26, 27, 28) being adapted to be connected alternately with said loaded gas supply channel (29) and the clean gas removal channel (23) by the shut-off device operated with the control units.

2. The apparatus of claim 1, wherein the two channels (29, 23) for supplying loaded gas and removing clean gas are disposed one above the other.

3. The apparatus of claim 2, wherein the clean gas removal channel (23) is disposed above the loaded gas supply channel (29).

4. The apparatus of claim 1, wherein the shut-off devices have lifting rods (50) adapted to move up and down, and closing bodies (50, 52, 53) fastened thereto.

5. The apparatus of claim 4, wherein the control units are formed by piston/cylinder units (54) having piston rods, and the lifting rods (50) are mounted flush with the piston rods of the piston/cylinder units (54).

6. The apparatus of claim 5, wherein the two towers (1, 2) are disposed at a distance apart so as to form a space (5).

7. The apparatus of claim 6, wherein the piston/cylinder units (54) are disposed in the space (5).

8. The apparatus of claim 1, wherein the switching chambers (26, 27, 28) are separated from the clean gas removal channel (23) by a first partition (30) and from the loaded gas supply channel (29) by a second partition (31), said shutoff devices each having a closing body, and each partition (30, 31) being provided with an opening (47, 48) to be closed by the closing body of the shutoff device for connection with the clean gas removal channel (23) and the loaded gas supply channel (29).

9. The apparatus of claim 5, wherein the switching chambers (26, 27, 28) are separated from the clean gas removal channel (23) by a first partition (30) and from the loaded gas supply channel (29) by a second partition (31), said shutoff devices each having a closing body, and each partition (30, 31) being provided with an opening (47, 48) to be closed by the closing body of the shutoff device for connection with the clean gas removal channel (23) and the loaded gas supply channel (29).

10. The apparatus of claim 8, wherein the two openings (47, 48) of at least one of the switching chambers (26, 27, 28) are offset.

11. The apparatus of claim 9, wherein the two openings (47, 48) of at least one of the switching chambers (26, 27, 28) are mounted flush with each other, the two closing bodies (52, 53) are displaceable between two stops (55, 56) which are provided on the lifting rods (50), said closing bodies lying against one or the other inner side of the two openings (47, 48) of the switching chamber (26, 27, 28) in the closed position and being spring-loaded away from each other, the two stops (55, 56) being disposed at a distance such that the two closing bodies (52, 53) can simultaneously come to lie against the inner side of the two openings (47, 48) of the switching chamber (26, 27, 28).

12. The apparatus of claim 1, wherein each tower (1, 2) is divided into three heat-retaining chambers (14 to 16, 17 to 19) by partitions (10 and 11, 12 and 13) extending from bottom to top, and the heat-retaining chambers (14 to 19) are adapted to be connected with a flush gas pipe for flushing.

13. The apparatus of claim 11, wherein each tower (1, 2) is divided into three heat-retaining chambers (14 to 16, 17 to 19) by partitions (10 and 11, 12 and 13) extending from bottom to top, and the heat-retaining chambers (14 to 19) are adapted to be connected with a flush gas pipe for flushing.

14. The apparatus of claim 1, wherein the combustion space has a floor (9) and a combustion device is disposed in the area of said floor (9).

* * * * *